US005492758A

United States Patent [19]

Baggett et al.

[11] Patent Number: 5,492,758

[45] Date of Patent: Feb. 20, 1996

[54] FIBER BLEND FOR CARPET YARNS AND WATERMARKING RESISTANT CARPET FORMED THEREFROM

[75] Inventors: William M. Baggett; Patrick Byrne, both of Pensacola, Fla.; Michael R. Sargent, Norcross, Ga.

[73] Assignee: Monsanto Company, St. Louis, Mo.

[21] Appl. No.: 81,942

[22] Filed: Jun. 25, 1993

[51] Int. Cl.[6] ..... D02G 3/00

[52] U.S. Cl. ..... 428/362; 428/369; 428/359; 428/92; 57/246; 57/247; 57/245; 57/255

[58] Field of Search ..... 428/357, 362, 428/369, 359, 92; 28/266; 57/246, 247, 245, 252, 254, 255

[56] References Cited

U.S. PATENT DOCUMENTS

| | | | |
|---|---|---|---|
| 2,849,785 | 9/1958 | McCulloagh et al. | 28/72 |
| 3,225,534 | 12/1965 | Knospe | 57/140 |
| 3,293,110 | 12/1966 | Stine et al. | 428/352 |
| 3,332,828 | 7/1967 | Faria | 428/97 |
| 3,667,094 | 10/1972 | Yazawa | 28/266 |
| 3,707,344 | 12/1972 | Guenter et al. | 57/244 |
| 3,852,948 | 12/1974 | Ruddell et al. | 57/140 |
| 3,967,441 | 7/1976 | Yasuzuka et al. | 57/140 |
| 4,078,110 | 3/1978 | Fletcher et al. | 428/364 |
| 4,167,847 | 9/1979 | Arai et al. | 57/244 |
| 4,173,678 | 11/1979 | Hennes et al. | 428/364 |
| 4,196,241 | 4/1980 | van Anholt et al. | 428/92 |
| 4,244,173 | 1/1981 | Lulay | 57/227 |
| 4,246,308 | 1/1981 | Walsh | 428/88 |
| 4,324,095 | 4/1982 | Lulay et al. | 57/327 |
| 4,331,729 | 5/1982 | Weber | 428/252 |
| 4,559,772 | 12/1985 | Heinrich et al. | 57/247 |
| 4,601,949 | 7/1986 | Bach et al. | 428/374 |
| 4,712,366 | 12/1987 | Tsujimoto et al. | 57/245 |
| 4,820,566 | 4/1989 | Heine et al. | 428/884 |
| 4,833,012 | 5/1989 | Makimura et al. | 428/288 |
| 4,839,211 | 6/1989 | Wilkie et al. | 428/89 |
| 4,848,413 | 7/1989 | Gray | 139/397 |
| 4,882,222 | 11/1989 | Tally, Jr. et al. | 428/362 |
| 4,910,062 | 3/1990 | Zinke et al. | 428/95 |
| 4,915,999 | 4/1990 | Tillotson | 428/957 |
| 4,918,912 | 4/1990 | Warner | 57/255 |
| 5,055,333 | 10/1991 | Heine et al. | 428/88 |
| 5,058,371 | 10/1991 | Yu et al. | 57/239 |
| 5,082,720 | 1/1992 | Hayes et al. | 428/224 |
| 5,102,713 | 4/1992 | Corbin et al. | 429/92 |
| 5,128,197 | 7/1992 | Kobayashi et al. | 428/225 |
| 5,140,495 | 8/1992 | Varvel | 361/220 |

FOREIGN PATENT DOCUMENTS 4102413 4/1992 Japan .

OTHER PUBLICATIONS

*Shading*, Technical Bulletin No. 3, Carpet Institute of Australia, 1986–1987.

G. A. Carnaly, E. J. Wood, *The Physics of Carpet*, Wool Research Organization of New Zealand, Inc. Christchurch, New Zealand, J. Text Inst., 1989, 80 No. 1 Textile Inst. pp. 71–90, especially §4.6 pp. 85–88.

Don Barnett, *Solutions*, Newsletter vol. 3, No. 1, Carpet Tech Services International Jan. 1993, pp. 1–4.

*Primary Examiner*—N. Edwards

[57] ABSTRACT

The present invention is directed to a fiber blend useful in the manufacture of carpet yarn used for pile in carpet construction. The blend includes, by weight based on the weight of the total blend, about 40% to about 70% normally crimped fibers, about 5% to about 50% crimpset fibers and about 4% to about 40% high shrinkage fibers having a shrinkage value of from about 15% to about 50%. Carpets including pile yarn formed from the blends of the present invention exhibit superior resistance to watermarking as well as other desirable characteristics.

7 Claims, No Drawings

FIBER BLEND FOR CARPET YARNS AND WATERMARKING RESISTANT CARPET FORMED THEREFROM

BACKGROUND OF THE INVENTION

1. Field of the Invention

The present invention is directed to a fiber blend useful in making carpet yarn. More specifically, the present invention is directed to a fiber blend, including three primary components, which is useful in forming a carpet yarn which, when fabricated into pile yarn in carpet, exhibits significantly improved resistance to watermarking, as well as other desirable characteristics.

2. Description of the Prior Art

Carpet "watermarking" also known as "pooling" is a phenomena wherein random, irregularly shaped areas or patches of carpet appear to the observer to have a color shade significantly different than the adjacent surrounding area. This phenomena is the result of pile direction irregularities, wherein random areas of tufts in a carpet incline in a different direction or to a greater degree than other adjacent areas. This difference in tuft inclination causes a variation in how light is absorbed by and/or reflected from the surface of the pile, thereby causing a perceived difference in shade. The difference in shade can be a lighter or darker appearance depending on the tuft orientation and the observer's viewing perspective.

While the reason behind these unsightly "watermarks" is for the most part understood, the reason for the development of these pile direction irregularities has remained elusive, causing disputes between carpet manufacturers, retailers and installers as to the origin of the watermarking problem. Significant quantities of installed carpet have developed watermarks and have been replaced at great expense only to have the phenomena appear soon after the new carpet is installed. "Watermarking" has also been observed on uninstalled carpet.

The prior art includes a number of distinct solutions to this unexplained problem. For example, U.S. Pat. No. 5,140,495 discloses a method and device for preventing "pooling" in carpets wherein air flow directed into a carpeted area is treated to neutralize its ionic content by positioning an electrode structure having a preselected potential in the air flow. This patent provides that "pooling" is apparently caused by an electric field which results from an accumulation of positive ions on particular areas of the carpet surface. JP04102413 discloses a carpet having a structure which avoids watermark-like shading. This structure includes nylon tufts attached to a primary base cloth laminate the back side of which is treated with a resin.

SUMMARY OF THE INVENTION

The present invention is directed to fiber blend useful in the manufacture of carpet pile yarn. The fiber blend includes three primary components: normally crimped fiber, crimpset fiber and high shrinkage fiber. The carpet yarn formed from this blend, when utilized as pile yarn in a carpet, provides a carpet which resists watermarking or pooling and also exhibits other desirable qualities such as improved bulk and appearance retention, a pleasing initial appearance and firmer hand, improved printability and a resistance to pilling and fuzzing.

DETAILED DESCRIPTION OF THE PREFERRED EMBODIMENTS

The term "fibers" as utilized herein, is defined to mean individual staple fibers or continuous filaments.

The term "shrinkage" used herein with reference to fibers, is determined by the following test: A sample of the fiber is placed under a tension of 0.100 grams per denier to fully extend the fiber (straighten out any crimp) without stretching or elongating the fiber. The length of the fiber in this condition is measured and recorded as $L_0$. The fiber is then immersed in boiling water for ten minutes under no tension, removed and allowed to cool and dry for 10 minutes under no tension, and then under a tension of 0.100 grams per denier, its length is again measured. The later measured length is recorded as $L_1$. Shrinkage is then determined by the following formula:

$$\% \text{ Shrinkage}=[(L_0-L_1)/]\times 100 \text{ or } (L_0-L_1/L_0)\times 100= \text{ shrinkage units.}$$

The fiber blends of the present invention include three primary components. The first component of the blends is normally crimped fibers present in an amount of between about 40% and about 70% by weight, preferably between about 50% and about 60% by weight, based on the total weight of the blend. "Normally crimped" fibers are defined as fibers which are crimped with sufficient energy to impart a high degree of crimp integrity to the fibers but which retain the capability to be fixed in a twisted position during heatsetting of twisted, plied yarn formed therefrom. Normally crimped fibers include fibers formed from conventional cold-crimping processes. The normally crimped fibers useful in forming the blends of the present invention have deniers of at least 10 dpf and a shrinkage of less than 12%. Preferably, the normally crimped fibers have shrinkages of less than 8%, most preferably less than 5%, and deniers of at least 12, most preferably between 15 and 25. Preferred normally crimped fibers are normally crimped polyamide fibers including normally crimped nylon 6,6 fibers and normally crimped nylon 6 fibers; normally crimped polyethylene terephthalate (PET) fibers or other polyester fibers; and normally crimped polyolefin fibers such as polypropylene fibers. Other suitable normally crimped fibers include normally crimped polyolefin fibers, such as normally crimped polypropylene fibers, as well as other normally crimped nylon and polyester fibers, such as normally crimped nylon 612 fibers or normally crimped polybutylene terephthalate fibers. The normally crimped fibers have a crimp frequency of between 5 and 16 crimps per inch (2–6 crimps per cm), most preferably 8–14 crimps per inch (3–6 crimps per cm). The fibers may be of round or non-round (eg., trilobal) cross section; however, non-round is preferred.

The normally crimped fibers are preferably staple fibers produced using conventional melt spinning techniques wherein the polymer in molten form is extruded from a spinneret to form a plurality of molten streams which are cooled to form filaments. These filaments are typically treated with a finish, collected in tow form, drawn, crimped and cut into staple fibers between about 6 and about 9 inches in length.

The second component of the blends of the present invention is crimpset fibers present in the amount of about 5% to about 50% by weight, preferably about 30% to about 50% by weight, based on the total weight of the blend. "Crimpset" fibers are defined as fibers which are crimped with sufficient energy to impart a high degree of crimp integrity to the fibers but which do not retain the capability to be fixed in a twisted position during the heatsetting of a twisted, plied yarn formed therefrom. The degree of crimp integrity and the amount of energy applied to impart the crimp are typically higher in crimpset fibers than in normally crimped fibers. Crimpset fibers useful in making the fiber blends of the present invention are crimped fibers having deniers of at least 10 (dpf) and shrinkage less than 12%. Preferred crimpset fibers are crimpset nylon 66 fibers, crimpset nylon 6 fibers and crimpset polyethylene terephthalate (PET) fibers. Other suitable crimpset fibers include crimpset polyolefin fibers, such as crimpset polypropylene fibers, as well as other crimpset nylon and polyester fibers, such as crimpset nylon 612 fibers or crimpset polybutylene terephthalate fibers. Preferably, the crimpset fibers have shrinkages of less than 8% and most preferably less than 5% and deniers of at least 12, usually between 15 and 25; a crimp frequency between 5 and 16 crimps per inch (2 to 6 crimps per cm), most preferably between 8 and 14 crimps per inch 3 to 6 crimps per cm), and a nonround cross-section (e.g. trilobal cross-section), although other cross-sections are useful. If desired, mixtures of crimpset fibers of different polymer composition (e.g. a nylon 66 and PET fiber mix) or a mixture of crimpset fibers differing only or as well as in denier, crimp or other characteristics may be used in the blend.

The crimpset fibers are preferably staple fibers produced by conventional melt spinning techniques wherein polymer is extruded through a spinneret to form molten streams which are cooled to form filaments. These filaments are typically treated with a finish, collected in tow form, drawn, crimped and cut into staple fibers, between about 6 and about 9 inches in length. As stated above, the amount of energy applied to impart the crimp of the crimpset fibers, and the resulting crimp integrity of the fibers, are higher than the corresponding application energy level and crimp of the normally crimped fibers.

The third component of the blends of the present invention is high shrinkage fibers present in the amount of about 4% to about 40% by weight, preferably about 10% to about 20% by weight, based on the total weight of the blend. High shrinkage fibers useful in making the fiber blends have shrinkages of from about 15% to about 50%. The high shrinkage fibers may be crimped without heat (e.g., cold crimped) or uncrimped and may be of a round or nonround cross section. The denier of the high shrinkage fibers may be the same as or different from the denier of the other carpet fibers of the blend. Preferred high shrinkage fibers will have shrinkages at least 10 shrinkage units higher than the shrinkages of the normally crimped fibers and most preferably at least 20 shrinkage units higher. Suitable fibers which are available in the requisite shrinkage range include, but are not limited to; polyester fibers (e.g. PET fibers); nylon copolymeric fibers, such as the copolymer consisting of hexamethylene adipamide (66) units, hexamethylene terephthalamide (6 TA) units and hexamethylene azelamide (69) units where the amounts of 6 TA and 69 units are selected to provide a copolymer having a melting point approximating that of the carpet fibers of the blend; and acrylic fibers. By acrylic fibers is meant fibers spun from a fiber-forming synthetic polymer composed of at least 85% by weight of acrylonitrile units and fibers (modacrylic fibers) in which the fiber-forming polymer is composed of less than 85% but at least 35% by weight of acrylonitrile units. Conventionally, the fiber-forming polymer is a copolymer of acrylonitrile with one or more vinyl compounds, such as: vinyl acetate, vinyl-pyridine, methylvinyl-pyridine, methyl methacrylate, vinyl chloride, vinyl bromide, and/or vinylidene chloride. Particularly preferred high shrinkage fibers for use in providing the blends of the present invention are acrylic fibers and PET fibers having shrinkages in the range of 20% to 35%. If desired, mixtures of high shrinkage fibers of different polymer composition and/or different shrinkages or other characteristics may be used in the blends (e.g. a mixture of acrylic and polyester high shrinkage fibers).

High shrinkage fibers of the fiber blends may be prepared by conventional techniques. For example, high shrinkage acrylic staple fibers may be obtained from acrylic tow having the desired shrinkage characteristics. In general, the more the tow is hot stretched, the greater is its shrinkage. The hot-stretching of the tow may be accomplished in a conventional manner either prior to cutting of the tow to staple or as a part of a stretch-break process. Typically, if the tow is hot-stretched 1.6 to 2.0 times its length, shrinkage of the tow will be in the range of 20 to 40%. High shrinkage PET fibers can be provided by known techniques selected to provide the desired shrinkages. The resulting yarns can be used in filament form or converted to staple of an appropriate length by conventional techniques.

The shrinkage of the high shrinkage fibers of the fibers blends must be preserved until the carpet yarns made from the blends are prebulked and/or heatset. Thus, it may be necessary to either cold crimp rather than hot crimp the high shrinkage fibers or to not crimp the high shrinkage fibers at all.

Preferably, blends useful in practicing the present invention consist of staple fibers because blends of staple fibers, as compared to blends of continuous filaments, are easier to make and offer greater flexibility with respect to varying the proportions of the carpet fibers and high shrinkage fibers, intimate blending thereof and incorporation of additional fiber components. Usually, carpet staple fibers are cut to a definite length, i.e. a length between 6 and 9 inches (15 to 23 centimeters) from a tow of substantially identical filaments to provide staple fibers which are of the same composition (e.g. nylon 66) and have the same denier, crimp frequency, cross-sectional shape and length. If desired, the carpet fibers of the blend may consist of a mixture (blend) of carpet staple fibers having, for example, different cross-sectional shapes and/or different deniers and/or different lengths and/or different polymer composition (e.g. nylon and PET) for the purpose of providing, for example, special dyeing effects or to improve the economics and/or luster and/or body of the carpet. The high shrinkage fibers of the staple blend preferably are cut to the same length as the carpet fibers of the blend.

In the case of continuous filament blends, the blend can be formed by, first, steam-jet texturing a yarn consisting of the normally crimped and crimpset carpet filaments; inserting high shrinkage filaments into the yarn (e.g. by means of an air tangling jet); and winding the resulting yarn consisting of the fiber blend on a bobbin.

The fibers blends may contain, in addition to normally crimped, crimpset and high shrinkage fibers, other fibers so long as the blend provides the above-mentioned characteristics. For example, the blend may contain fibers made from wool, cotton, metal, carbon, etc. or fibers that contain inorganic, organic or polymeric additives, for example carbon black, titanium dioxide, or polyethylene glycol. It is also contemplated that all or a portion of fibers of the blends may be coated with materials such as fluorocarbons and/or stain blockers for the purpose of improving the soil and stain resistance of the fibers.

The polymer composition of the fibers of the blend is selected to permit processing of the fibers into yarns and carpet, bearing in mind, temperatures, stresses, etc., generally encountered.

The fiber blends of the present invention are useful for forming pile yarns which form the pile or tufts of a carpet. The yarns of the present invention are preferably formed from blends of staple fibers by conventional techniques. For example, the blend is processed into a plied yarn by blending together the three staple components, carding the blend into a sliver, drafting and twisting the sliver into a spun yarn and plying and twisting pairs of the spun yarn to form a plied yarn. An especially useful yarn is produced by imparting a ply twist level of 3.9 to 4.4 turns per inch. The plied yarn is then heatset by conventional means to set the twist. An especially useful plied yarn is produced by heat setting the yarn with a moist heating process using conventional SUPERBA® equipment.

The yarns of the present invention, after heat setting, are tufted into a primary backing and sheared to form a plurality of tufts of the yarn of the present invention which project upwardly from the backing and terminate in a cut end. The carpet of the present invention includes the tufts and the primary backing and preferably further includes a secondary backing adhered to the primary backing at its bottom surface with an adhesive which is preferably applied as a latex and which preferably includes an inorganic filler such as calcium carbonate. This carpet exhibits a strong resistance to watermarking as demonstrated in the non-limiting example set forth below.

EXAMPLE 1

Molten nylon 6,6 polymer is spun conventionally into a bundle of 60 denier filaments at a temperature of about 290 degrees C., solidified with a cross current of cooling air, treated with a fiber lubricant and water emulsion and collected in continuous tow form for subsequent processing. The resultant tow is then processed into drawn, crimped carpet staple fiber using two different processes such that two fiber components are produced which differ in the degree to which the fiber crimp is thermally set. In the first staple component, the spun tow is stretched on a drawstand at a draw ratio of approximately 3.5:1 and compressed in a stufferbox in the presence of steam at atmospheric pressure and the tow is cut to staple fiber about 7.5" in length. This first staple component is referred to herein as "normally crimped" fiber. In the second staple component, the spun tow is drawn and crimped in an identical process to the first component except the crimped tow is further heat treated under pressure in a steam atmosphere at a temperature of about 130 degrees C. before being cut to staple fiber about 7.5" in length. This second staple component is referred to herein as "crimpset" fiber. A third staple component is produced in a separate process by solution spinning a bundle of acrylic fibers into a crimped tow, annealing this tow in an autoclave at about 48 PSIG in a steam atmosphere followed by vacuum for a series of 5 to 7 cycles then stretching the annealed tow in steam at atmospheric pressure at a draw ratio of about 2.7:1, crimping in a stufferbox without steam and cutting to a 6" staple length.

The three staple components are then blended together in an exemplary ratio of 58% of the first component, 30% of the second component and 12% of the third component. This blend is then carded into a staple sliver of approximately 500 grain weight on a 60" compact card and drafter, 10–11 ends of this card sliver processed into a 550 grain sliver in an initial pin drafting step, followed by 6 ends of the initial pin drafted sliver processed into 200 grain sliver on an intermediate pin drafting unit and a final sliver prepared by combining two ends of the intermediate sliver and pin drafting into a 65 grain finisher sliver.

The finisher sliver is further drafted, twisted into a spun yarn and wound onto a package using a spinning frame. The spun yarn is plied and twisted together in pairs using a standard plytwisting machine with the twist added in the direction opposite from the twist in the spun yarn.

The plytwisted yarn is then subjected to a moist heatsetting process to thermally set the yarn twist using commercially available SUPERBA® equipment.

The heatset yarn is then utilized as pile yarn in the manufacture of the carpet samples listed below. More specifically, the heatset yarn is stitched into a polypropylene primary backing material and sheared to form a plurality of tufts which project upwardly from the backing and terminate in a cut end. A calcium carbonate-filled latex adhesive is then applied to adhere a polypropylene secondary backing material to the primary backing material and complete the carpet sample construction.

TABLE 1

| Sample | Pile Weight, oz/vd$^2$ | Pile Height, Inches | Gauge |
|---|---|---|---|
| 1 | 32 | 9/32 | 1/10 |
| 2 | 38 | 5/16 | 1/10 |
| 3 | 38 | 5/16 | 1/10 |
| 4 | 32 | 9/32 | 1/8 |
| 5 | 66 | 1/2 | 1/10 |
| 6 | 66 | 1/2 | 1/10 |
| 7 | 66 | 1/2 | 1/10 |

These seven carpet samples were installed at a building location which historically has demonstrated a strong and repeated propensity for carpet watermarking. The installed samples remained at this location for a three-month test period during which they were subjected to normal use and traffic.

After the three-month test period, the samples were visually assessed and evaluated. Six of the seven samples showed no visible evidence of watermarking and one sample exhibited slight visible watermarking.

Although the present invention has been described in terms of its preferred embodiments, it is to be understood that various modifications may be made to the present invention which do not depart from its spirit and scope. For example, the fibers utilized in the blends of the present invention may be dyed or pigmented to impart color thereto. Further, the blends may be utilized in the manufacture of various types of carpet constructions.

We claim:

1. A fiber blend useful in the manufacture of carpet yarn, said blend comprising, (a) about 40% to about 70% by weight based on the total weight of the blend of normally crimped fibers;

(b) about 5% to about 50% by weight based on the total weight of said blend of crimpset fibers; and (c) about 4% to about 40% by weight based on the total weight of said blend of high shrinkage fibers having a shrinkage value of about 15% to about 50%.

2. A fiber blend in accordance with claim 1 wherein said normally crimped fiber and said crimpset fiber are nylon 6,6 fibers.

3. A fiber blend in accordance with claim 2 wherein said high shrinkage fibers are acrylic fibers.

4. A fiber blend useful in the manufacture of carpet yarn, said blend comprising:

(a) about 50% to about 60% by weight based on the total weight of the blend of normally crimped fibers;

(b) about 30% to about 50% by weight based on the total weight of the blend of crimpset fibers; and (c) about 10% to about 20% by weight based on the total weight of the blend of high shrinkage fibers having a shrinkage value of about 20% to about 35%.

5. A yarn formed from the blend of claim 1.

6. A yarn formed from the blend of claim 3.

7. A yarn formed form the blend of claim 4.

* * * * *

UNITED STATES PATENT AND TRADEMARK OFFICE

CERTIFICATE OF CORRECTION

PATENT NO. : 5,492,758

DATED : Feb. 20, 1996

INVENTOR(S) : Baggett et al.

It is certified that error appears in the above-indentified patent and that said Letters Patent is hereby corrected as shown below:

Column 2, lines 17 to 19, that portion of the formula reading $[(L_0-L_1)/]x100$ should read $[(L_0-L_1)/L_0]x100$ Signed and Sealed this Thirteenth Day of August, 1996

Bruce Lehman

*Attest:*

BRUCE LEHMAN

*Attesting Officer*

*Commissioner of Patents and Trademarks*